US005396667A

United States Patent [19]

Egli et al.

[11] Patent Number: 5,396,667

[45] Date of Patent: Mar. 14, 1995

[54] TANK, IN PARTICULAR A FLUSH TANK, WITH A MOUNTING ELEMENT ATTACHED THEREON

[75] Inventors: Anton Egli, Rieden; Peter Lechner, Jona, both of Switzerland

[73] Assignee: Geberit AG, Jana, Switzerland

[21] Appl. No.: 120,132

[22] Filed: Sep. 10, 1993

[30] Foreign Application Priority Data

Sep. 14, 1992 [CH] Switzerland ..... 2890/92

[51] Int. Cl.[6] ..... E03D 1/012

[52] U.S. Cl. ..... 4/419; 4/353

[58] Field of Search ..... 4/353, 416, 419, 496, 4/506

[56] References Cited

U.S. PATENT DOCUMENTS 1,430,571 10/1922 Leslie ..... 4/353
4,519,175 5/1985 Resan .
4,967,424 11/1990 Stegmeier ..... 4/506 X
4,999,963 3/1991 Verble .

FOREIGN PATENT DOCUMENTS 394596 10/1991 Austria .
0319467 6/1989 European Pat. Off. ..... 4/353
0407352 1/1991 European Pat. Off. .

*Primary Examiner*—Charles E. Phillips
*Attorney, Agent, or Firm*—Bucknam and Archer

[57] ABSTRACT

For the purpose of attaching the frame (1) to the tank (6), the tank (6) has on the outer side niches (18) which are widened inwardly. Opposite each of the niches (18) the frame (1) has an opening (4). Connecting members (9) are each snapped into an opening (4) and engage at an inner end into a niche (18). Wedges or pins (10) driven into a recess (13) fix a tenon (17) engaging the niche (18) from behind. Simple and automatable operations suffice for the installation.

9 Claims, 2 Drawing Sheets

TANK, IN PARTICULAR A FLUSH TANK, WITH A MOUNTING ELEMENT ATTACHED THEREON

FIELD OF THE INVENTION

The invention relates to a tank in particular a flush tank with a mounting element attached thereon.

BACKGROUND OF THE INVENTION

A known concealed flush tank has laterally integrally formed fishplates, to which a sheetmetal mounting frame is screwed. This flush tank is made by blow-molding, and the fishplates, extending essentially over the full height of the tank, require a complicated mold separation of the blow-molding die. To achieve secure attachment of the mounting frame, several screws must be applied, which requires substantial labor. The production risk and the number of possible cases of damage are comparatively high for this flush tank due to the relatively expensive manufacture and installation.

Known also is a flush tank on the outside of which fishplates are welded on by ultrasonics for attachment of a mounting frame. It has been found that even with very careful working the welding quality is irregular and crack formation at the flush tank is possible. The production risk and cost of inspection are therefore high also for this flush tank.

According to the present state of the art, therefore, there is a need of a flush tank or similar tank which avoids the cited disadvantages and which thus is easier to manufacture at lower production and inspection costs and can be attached on a mounting element, in particular a mounting frame.

SUMMARY OF THE INVENTION

It is therefore an object of the invention to provide a tank, in particular a flush tank with a mounting frame secured thereon, which meets these more stringent requirements.

The niche proposed for the tank according to the invention permits a much simpler mold separation of the blow die than is possible with a tank with laterally protruding fishplates. The union can be a simple plug union, thus permitting simple, automatable installation without the use of screws. Welding operations and possible crack formations are also avoided. Instances of damage are hardly to be expected with the tank according to the invention. The production risk and cost of inspection are reduced as compared with the known flush tanks.

According to one embodiment, the niches in the flush tank are formed as continuous grooves, whereby the above-mentioned mold separation is further simplified. If in addition centering tenons in the grooves and a matching groove in the connecting member are provided, this ensures a simple and besides reliable lateral fixation of the flush tank on the mounting frame. The attachment of the flush tank is especially stable if the connecting member has two wedges which are disposed side by side and assure a snap union.

Other advantageous features will become evident from the dependent claims and from the following description.

BRIEF DESCRIPTION OF THE DRAWINGS

An embodiment of the invention will be explained more specifically below with reference to the drawing, in which.

Figure 1:
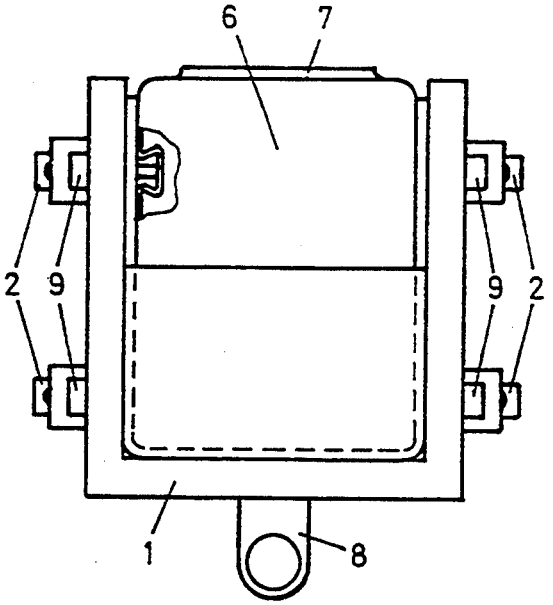
FIG. 1 is a partially sectional view of a concealed flush tank with a mounting frame fastened thereon.
Figure 2:
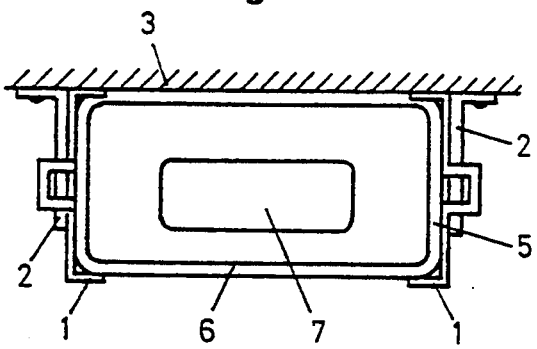
FIG. 2 another view of the flush tank and frame of FIG. 1.

A U-shaped mounting frame 1, preferably made of sheetmetal, is attached to a concealed flush tank 6 known per se by several connecting members 9. Normally the mounting frame 1 is, according to FIG. 2, attached to a building wall 3 by attachment brackets 2. These brackets may be designed for example like those according to EP-A-0407352. The mounting frame 1 permits the flush tank 6 to be installed projecting. The mounting frame 1 may also be another mounting element suitable for mounting the flush tank 6. As usual, a drain elbow 8 is provided at the bottom of tank 6, and in the upper part an inspection opening 7. Flush tank 6 may also be another plastic tank customary in sanitary technology.

Between frame 1 and tank 6 an interstice 20 for a condensation insulation 5 is provided. The distance between frame 1 and tank 6 is preferably chosen so that the insulation 5 is clamped between them.

Figure 3:
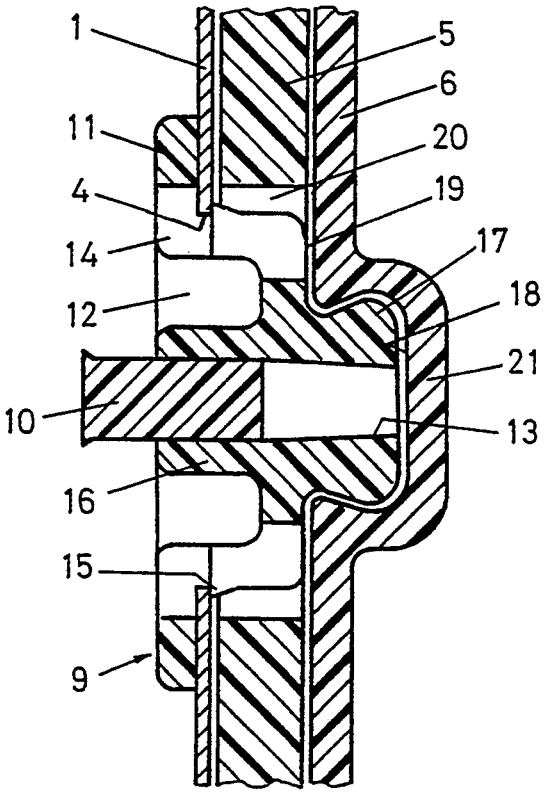
FIG. 3 and 4, are vertical sections through a junction between the flush tank and the mounting frame.
Figure 4:
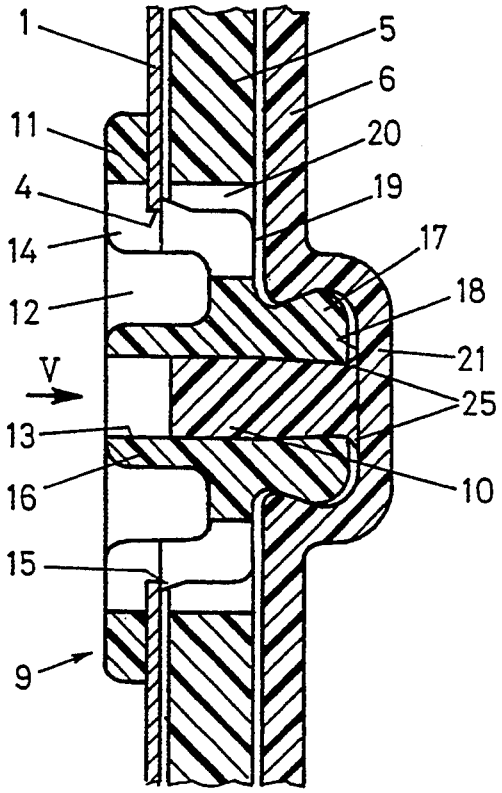
Figure 5:
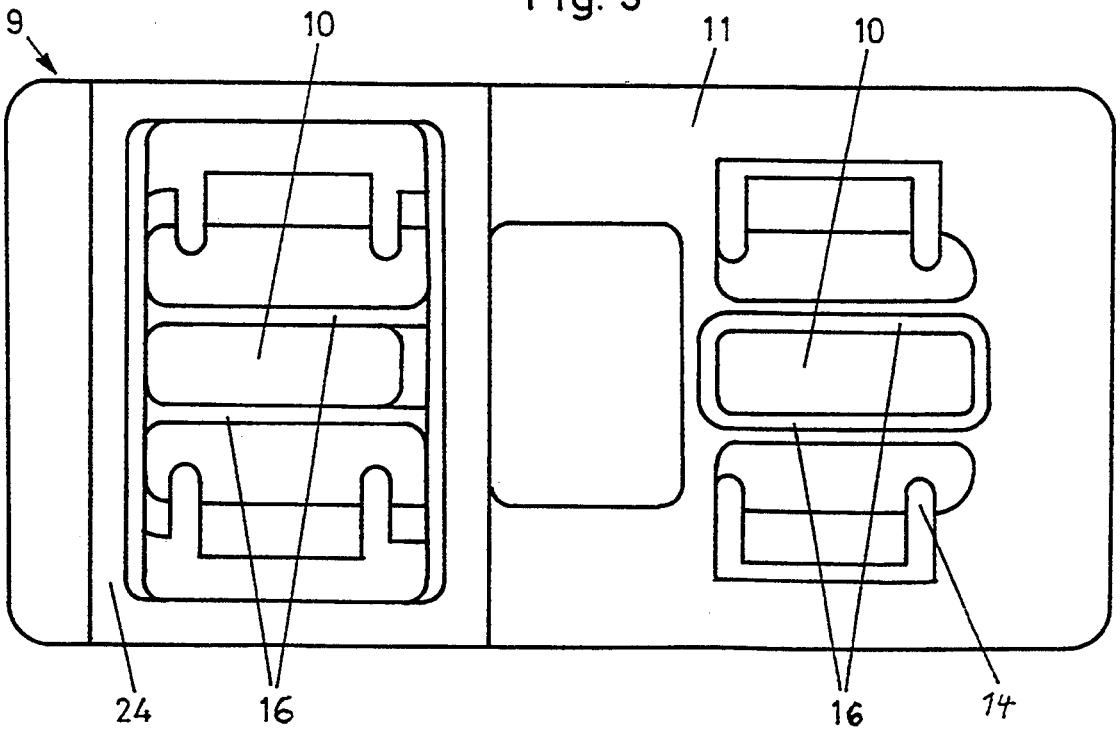
FIG. 5 a view of the connecting member in the direction of arrow V in FIG. 4.

Frame 1 is secured essentially undetachably on tank 6 by several connecting members 9. These members 9 are made of plastic and are inserted from the outside into an opening 4 of frame 1 and locked. A flange 11 bears against the outer side of frame 1, and tenons 15 engage the opening 4 from behind. Thus the connecting members 9 are fixed on frame 1. As FIG. 3 shows, a tenon 17 is integrally formed on flange 11 by webs 14, approximately at the center. This tenon 17 is inserted in a niche 18 formed as a snap-in groove in a wall of tank 6. A shoulder of the connecting member 9 abuts against the outside of tank 6. The inwardly widening niche 18 is engaged from behind by the tenon 17. In order to make sure that tenon 17 is securely fixed in niche 18, a wedge or pin 10 is, according to FIG. 3, inserted into recess 13 from the outside up to the stop at a wall portion 21. Under elastic radial deflection of the front regions of tenon 17, the latter assumes the spread-out position shown in FIG. 4. In the arrangement of FIG. 4, the wedge 10 forms a clamping means which fixes tenon 17 in niche 18 and prevents it from coming out of niche 18. Tank 6 is thus secured in all directions to the connecting member 9. The wedge 10 in order to be secured in recess 13, has at its front end catches 25 protruding laterally, which in the arrangement according to FIG. 4 engage tenon 17 from behind. In view of the fact, as mentioned above, that the connecting member 9 is immovably fixed also on the mounting frame 1, mounting frame 1 and flush tank 6 are firmly joined together at a certain distance. As a rule, several, for example four, connecting members 9 are provided.

Figure 6:
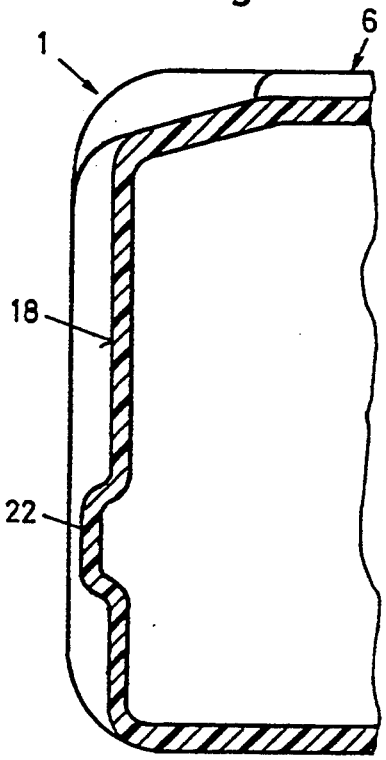
FIG. 6 a horizontal section through a part of a flush tank.

Niche 18 is preferably a snap groove extending horizontally and over the full width of tank 6, as shown in FIG. 6. In the groove a centering tenon 22 is provided, which according to FIG. 7 engages in a matching groove 23 of connecting member 9, so that lateral displacement of tank 6 relative to the mounting frame 1 is prevented.

Figure 7:
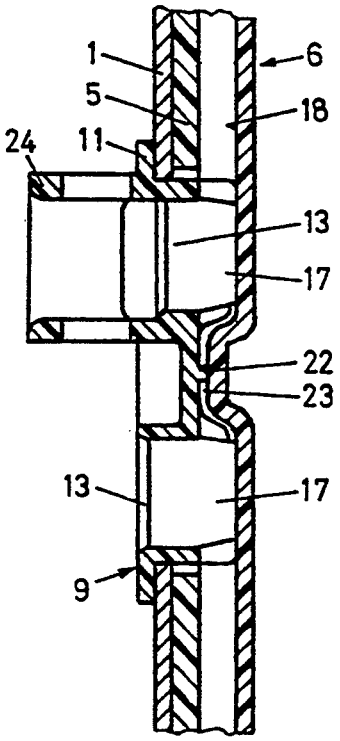
FIG. 7 a horizontal section through a part of a flush tank and a connecting member applied thereon.

As FIG. 7 further shows, connecting member 9 has two recesses 13, between which the grooves 23 are arranged and which receive a wedge 10 not shown here.

Over one recess, a fishplate 24 is arranged, which is provided to receive a fastening bracket 2. The connecting members 9 can thus serve at the same time to attach the frame on a building wall.

For attachment of frame 1 on tank 6, tank 6 together with the insulation 5 is inserted into frame 1. Then the connecting members 9 are inserted from the outside into the openings 4 until flange 11 abuts and the tenons 15 are snapped in. At the same time tenon 17 engages into a niche 18. Finally it suffices to drive the wedges or pins 10 as per FIG. 3 and 4. As mentioned above, the distance between the frame and the flush tank 6 can be chosen so that when the connecting members 9 are applied, the insulation 5 is clamped between frame 1 and tank 6. Thus, relatively simple and automatable operations are required for the attachment of the mounting frame 1.

Since the flush tank 6 has no outwardly protruding fishplates, it is less wide and more manageable, a feature which is essential especially for transportation. At the same time the consumption of material should be less, which is also economically important in view of the large quantities common in this field.

What is claimed is:

1. The combination of a flush tank (6) and a frame (1) for mounting said flush tank, said frame (1) being attached to a wall (3) of a building, said flush tank (6) having a body with an outer side, said frame having an outer side and an inner side and being attached to said outer side of said body, connecting members (9) for connecting said frame (1) to said outer side of said body of said flush tank (6), said frame having openings (4), each of said connecting members (9) being inserted into a respective one of said openings, said outer ride of said flush tank having niches (18), opposite said openings, when said tank is placed in said frame (4), each connecting member (9) being inserted from the outside of said frame (1) into an opening (4) of the frame (1) and into a niche (18) of said body of said flush tank (6), each connecting member (9) having means for abutting the frame (1) and means for clamping in a niche (18) of said body of said flush tank (6).

2. The combination according to claim 1, wherein said connecting members (9) are fixed to said frame by snap engagement and are fixed in said niches (18) by clamping.

3. The combination according to claim 2, wherein said connecting members (9) have a recess (13) and the combination includes a wedge (10) insertable into said recess from the outer side of said body of said flush tank.

4. The combination according to claim 1, wherein said connecting members (9) have a shoulder (19), said niches having two sides, said connecting members (9) bearing on said two sides of said niches (18) against said body of said flush tank (6), and said flush tank is spaced from said frame (1).

5. The combination according to claim 4, wherein said connecting members comprise flanges (11), said shoulder (19) is formed by webs (14), and said webs (14) connect said flanges (11) bearing against said frame (1).

6. The combination according to claim 4, wherein an interstice (20) is provided between said body of said flush tank and said frame and an insulating material (5) is placed into said interstice.

7. The combination according to claim 1, wherein said body of said flush tank has a width, and said niches (18) extend over the entire width of said body of said flush tank horizontally and a first centering tenon (22) is located in each of said niches, said connecting members (9) have a groove (23) and said first centering tenons (22) engage with said grooves (23).

8. The combination according to claim 1, wherein said connecting members have second tenons (15), said tenons (15) engage said openings (4).

9. The combination according to claim 8, wherein third tenons (17) are formed integrally with said flanges and said third tenons (17) are insertable into said niches.

* * * * *